United States Patent [19]

Pawlowski

[11] Patent Number: 4,966,360

[45] Date of Patent: Oct. 30, 1990

[54] TRANSPORT DEVICE FOR A MULTIPLE LAYERED WEB MATERIAL

[75] Inventor: Adam Pawlowski, Berlin, Fed. Rep. of Germany

[73] Assignee: Nixdorf Computer AG, Paderborn, Fed. Rep. of Germany

[21] Appl. No.: 403,337

[22] Filed: Sep. 6, 1989

[30] Foreign Application Priority Data

Sep. 9, 1988 [DE] Fed. Rep. of Germany ... 8811453[U]

[51] Int. Cl.[5] ..... B65H 5/06

[52] U.S. Cl. ..... 271/272; 29/116.1; 271/119; 226/181; 226/194

[58] Field of Search ..... 226/181, 190, 194; 271/119, 272; 29/116.1

[56] References Cited

U.S. PATENT DOCUMENTS

| | | | |
|---|---|---|---|
| 503,276 | 8/1893 | Barnes | 271/119 |
| 3,186,195 | 6/1965 | Braun | 226/190 X |
| 3,411,686 | 11/1968 | Bender | 226/194 X |
| 3,937,455 | 2/1976 | Hauser | 271/119 X |

*Primary Examiner*—Richard A. Schacher

[57] ABSTRACT

A transport device for multiple layered web material consists of a transport roll and a pressure roll between which the web material passes. The pressure roll is in the form of a hollow prism mounted with play on a supporting shaft. The interior of the prism has rounded corners with a radius of curvature matching that of the shaft. During rotation of the pressure roll, the transport roll translates with the web material during some portions of its movement and rotates relative to the shaft during other portions of its movement.

9 Claims, 1 Drawing Sheet

TRANSPORT DEVICE FOR A MULTIPLE LAYERED WEB MATERIAL

Figure 1:
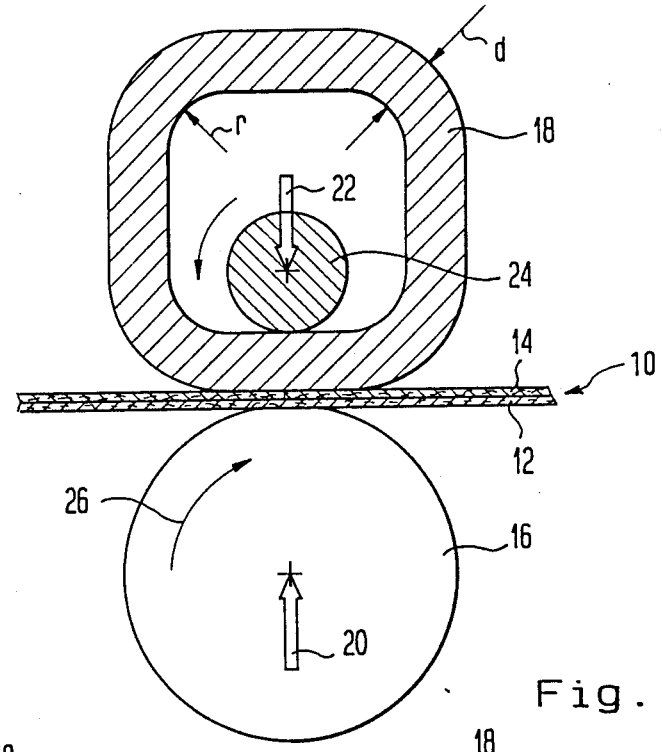

The invention concerns a transport device for a multiple layered web material, especially a multiple layered graphics carrier in a printing device with at least one transport roll and at least one pressure roll associated with the transport roll with its axis parallel to the axis of the transport roll, with the transport roll and the pressure roll being biased toward one another in the radial direction.

A transport device of this type is known from DE-OS 3511386. It operates satisfactorily with a simple web material. However, when the web material consists of several superimposed webs, which are wound in common onto a roll, shifting of the individual webs relative to one another can occur, which because of the different web lengths of the roll leads to waves or bows which then, in the transport gap between the transport roll and the pressure roll, form folds and altogether so deform the web material that an orderly further transport of it is no longer possible. Such phenomenon occur especially in the case of so-called check-journal rolls, which are for example to be printed in cash printers. In the case of a deformation or distortion of the sheet material in the previously described way, an orderly printing of such a manifold document is no longer possible.

The invention basically has as its object, the provision of a transport device of the aforementioned type in which the transport faults of the previously described type do not appear, so that even in the case of a multiple layered web material, a trouble-free and uniform transport of all the layers through the transport gap is guaranteed.

This object is solved in accordance with the invention in that the pressure roll has the form of a straight hollow prism open at both ends with a uniform wall thickness over its entire circumference and that the pressure roll is supported by a shaft passing through the hollow space of the prism with play.

The pressure roll under these conditions undergoes two movements: In the curved corner areas, it rotates about the rotational axis of its shaft, so that it also rolls on the circumference of the transport roll or on the web material to be transported. Between the corners, it undergoes a translatory movement in which it is carried along with the web material and shifted relative to its shaft. Surprisingly it has been shown that only the part of the web material which stands in direct contact with the pressure roll remains behind in comparison to the other web material taken along by the transport roll when the corner area of the pressure roll forms the contact surface with the transport roll, that is, when the pressure roll itself rolls on the web material. In this case, it is especially advantageous for the undisturbed running of the web material, if the pressure roll has rounded corners. These positive properties are further increased in an advantageous way if the radius of curvature of the curved corner areas of the inside circumferential surface of the hollow space of the prism is equal to the radius of the shaft. When the translatory movement portions of the pressure roll occur no slipping between the layers of the web material appears. The cross-section of the prism can have any desired polygonal shape. Preferably it is square or triangular with the corners being curved in the previously described way.

As known from DE-OS 3511387 several pressure rolls can be provided which are arranged with axial spacing on the same shaft, with the shaft mid-way between the pressure rolls being pivotally supported on an axis which is perpendicular to a plane containing the axes of the transport roll and the pressure roll.

Figure 2:
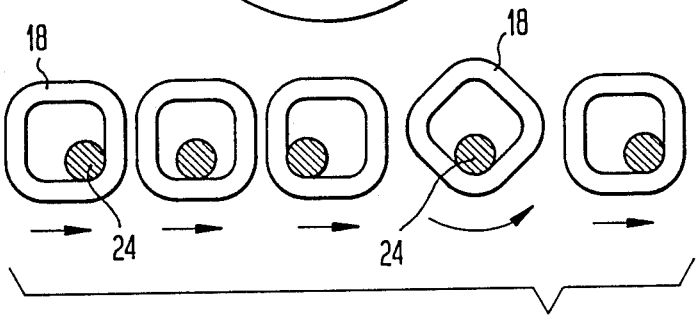
Figure 3:
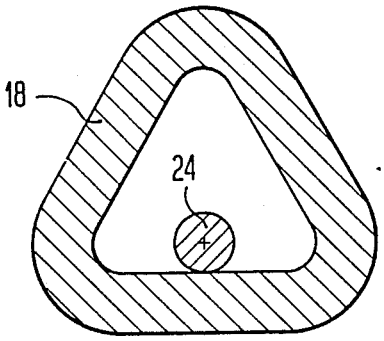

The following description explains the invention in association with the accompanying drawings and by way of exemplary embodiments. The drawings show:

FIG. 1—A schematic simplified section through the transport device of the invention perpendicular to the axis of the transport roll and the pressure roll, FIG. 2—A schematic illustration of the movement sequence of the pressure roll illustrated in FIG. 1, and FIG. 3—A section taken normal to the axis through the pressure roll of another embodiment of the invention.

In FIG. 1, a paper web, which consists of two layers 12 and 14, is shown at 10. The paper web 10 runs between a transport roll 16 and a pressure roll 18, which are urged toward one another in the direction of the arrows 20 and 22. The transport roll 16 can be made of an elastically deformable material at least in the area of its circumference.

The pressure roll 18 has the shape of a straight hollow prism with square cross-section open at both ends, with the corners of the prism being arcuately curved. The wall thickness (d) of the prismatic pressure roll 18 is entirely constant, that is the same in the straight sections as in the curved sections of the wall. The radius of curvature (r) of the inner circumferential surface in the area of the corners is the same as the radius of the shaft 24 which passes axially through the hollow space of the pressure roll 18.

This prismatic shape of the pressure roll 18 in combination with its loose support on the shaft 24 leads to a movement of the pressure roll 18 the phases of which are illustrated in FIG. 2 progressively from left to right for a quarter rotation of the pressure roll 18. In the case of the given rotational sense of the transport roll 16, as shown by the arrow 26 of FIG. 1, the pressure roll 18 first moves in translation along with the web material 10 until the shaft 24 engages the left corner of the pressure roll 18 (middle picture of FIG. 2). It has been shown, that during this movement phase no shifting of the layers 12 and 14 relative to one another appears. The pressure roll 18 next rotates about the shaft 24 (FIG. 2 fourth picture from left), until it again lies upon the paper web 10 with its following flat side (FIG. 2 right hand picture). In the case of this rolling movement under some circumstances a shifting of the layers 12 and 14 relative to one another can take place.

Therefore, with the above described apparatus, a shifting of the layers 12 and 14 of the paper web relative to one another cannot be 100 percent foreclosed, however, it is considerably reduced.

FIG. 3 shows an embodiment of a pressure roll 18 having a triangular cross-section instead of the square cross-section illustrated in FIG. 1. The movement progressions during a rotation of this pressure roll follows in the same way as that described above in connection with FIG. 2.

I claim:

1. A transport device for multiple layered web materials (10), especially multiple layered graphic carriers for a printing device, with at least one transport roll (16) and at least one associated pressure roll (18) with an axis parallel to the axis of the transport roll, with the transport roll (16) and the pressure roll (18) being biased toward one another in a radial direction, characterized in that the pressure roll (18) has the shape of a straight hollow prism open at both ends with a wall thickness uniform over its entire circumference, and that the pressure roll (18) is supported on a shaft (24) passing through the hollow space of the prism with play.

2. A transport device according to claim 1 further characterized in that the prism has rounded corners.

3. A transport device according to claim 2, further characterized in that the radius of curvature (r) of the rounded corner areas of the inner circumferential surface of the prism hollow space is equal to the radius of the shaft (24).

4. A transport device according to claim 1 further characterized in that the prism has a square cross-section.

5. A transport apparatus according to claim 1 further characterized in that the prism has a triangular cross section.

6. A transport device according to claim 4 further characterized in that the prism has rounded corners.

7. A transport device according to claim 6 further characterized in that the radius of curvature (r) of the rounded corner areas of the inner circumferential surface of the prism hollow space is equal to the radius of the shaft (24).

8. A transport device according to claim 5 further characterized in that the prism has rounded corners.

9. A transport device according to claim 8 further characterized in that the radius of curvature (r) of the rounded corner areas of the inner circumferential surface of the prism hollow space is equal to the radius of the shaft (24).

* * * * *